US006102392A

United States Patent [19]

Gleichauf et al.

[11] Patent Number: 6,102,392

[45] Date of Patent: Aug. 15, 2000

[54] ARRANGEMENT FOR THE AUTOMATIC AND CONTINUOUS ADAPTATION OF THE DOCUMENT ACCEPTANCE RATE TO THE DOCUMENT OUTPUT RATE OF DOCUMENT OUTPUT DEVICES

[75] Inventors: Markus Gleichauf, Blumberg; Siegfried Moeller, Rottwell; Speck Elmar, Roettingen, all of Germany

[73] Assignee: BDT Buro - und Datentechnik, GmbH & Co. KG, Schwenningen, Germany

[21] Appl. No.: 09/128,424

[22] Filed: Aug. 4, 1998

[30] Foreign Application Priority Data

Aug. 4, 1997 [DE] Germany ..... 197 33 695

[51] Int. Cl.[7] ..... B65H 7/02

[52] U.S. Cl. ..... 271/265.02; 271/265.01; 271/176; 271/188

[58] Field of Search ..... 271/265.01, 265.02, 271/265.04, 176, 188, 263, 258.01, 3.15

[56] References Cited

U.S. PATENT DOCUMENTS 4,451,030 5/1984 Teeter et al. ..... 271/188

4,548,394 10/1985 Koyama et al. ..... 271/265.01

FOREIGN PATENT DOCUMENTS 402038241 2/1990 Japan ..... 271/265.01

404327446 11/1992 Japan ..... 271/265.01

*Primary Examiner*—H. Grant Skaggs

*Attorney, Agent, or Firm*—Higgs, Fletcher & Mack LLP; Bernard L. Kleinke

[57] ABSTRACT

An arrangement for the control of movement of documents to an output device such as a printer or a copier in such a manner that the document draw-in rate automatically matches the document output rate. A document intake channel forces the incoming document into a curvature transversely to the direction of the transport of the documents, whereby the degree of curvature of the documents is a function of any tensile force on the documents. A sensor includes an analog and continuous output signal to affect a continuous change of the driving frequency for a motor causing the movement of the documents as a function of the actuation of the sensor.

8 Claims, 2 Drawing Sheets

Figure 1:
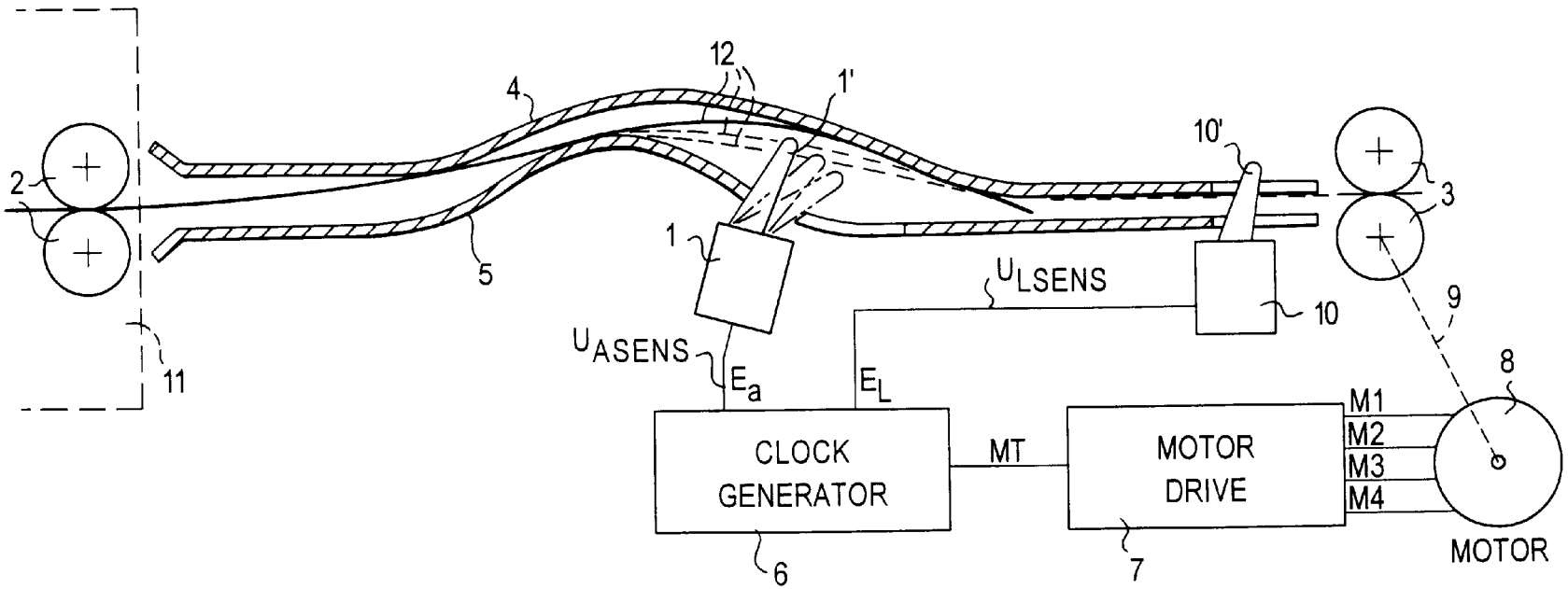

ARRANGEMENT FOR THE AUTOMATIC AND CONTINUOUS ADAPTATION OF THE DOCUMENT ACCEPTANCE RATE TO THE DOCUMENT OUTPUT RATE OF DOCUMENT OUTPUT DEVICES

The invention relates to an arrangement for the automatic and continuous adaptation of the document acceptance rate to the document output rate of an output device such as a printer or a copier as a function of the document arching in the document intake channel via the tensile force at the documents by the document acceptance device without electrical communication between output and acceptance device.

It is the object of the invention to match the document draw-in rate automatically to the document output rate.

The invention is based on the task of controlling the draw-in rate for documents via an analog sensor in a curvature region of the documents in the document intake channel in analog manner such that the document draw-in automatically adapts to the document output rate and permits variations of the document output rate within wide limits. Means of the invention are a sensor with an analog output signal in the curvature region of the documents, wherein the degree of curvature is related to the draw-in rate of the document transport roller system of the document acceptance device, and a clock generator, as a function of the analog sensors signal of the cited sensor, generates a clock frequency for, for example, a stepping motor such that a predetermined curvature of the documents in the document draw-in channel results, which ensures that the document draw-in rate adapts automatically to the document extraction rate.

From DE 23 52 339 A1 is known an arrangement with a document insertion device of the document intake channel which includes a deformation region for forming a curvature of the documents transversely to the direction of transport and comprises in the curvature region of the documents a sensor device. The document output device and the document draw-in device can be driven at different speeds. However, no voltage-controlled oscillator is described which drives the motor as a function of the analog output signal of the sensor.

The invention will be explained in further detail in conjunction with the following drawings (FIGS. 1 to 3) by example of an embodiment example. In the drawings are depicted:

FIG. 1 schematic representation of the document intake channel with the disposition of the analog sensor (1) in the curvature region of the documents (12) as well as the functional assignment of the sensors to a clock generator, motor control and motor.

Figure 2:
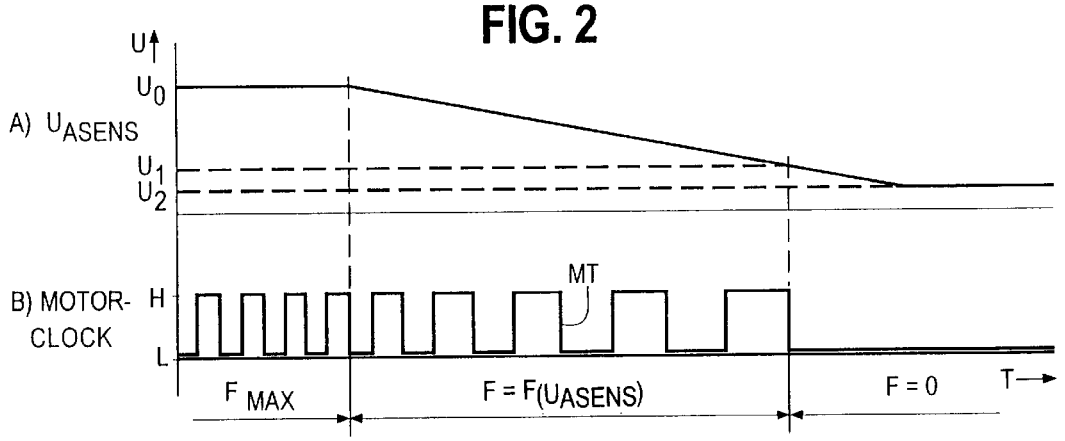

FIG. 2 Illustration of the relationship of the clock frequency for the motor drive as a function of the analog output signal of the sensor (1) in the curvature region. Therein show the lines:

a) analog output signal of the sensor (1) in the curvature region b) clock frequency for driving of the motor as a function of the analog level of the sensor (1).

Figure 3:
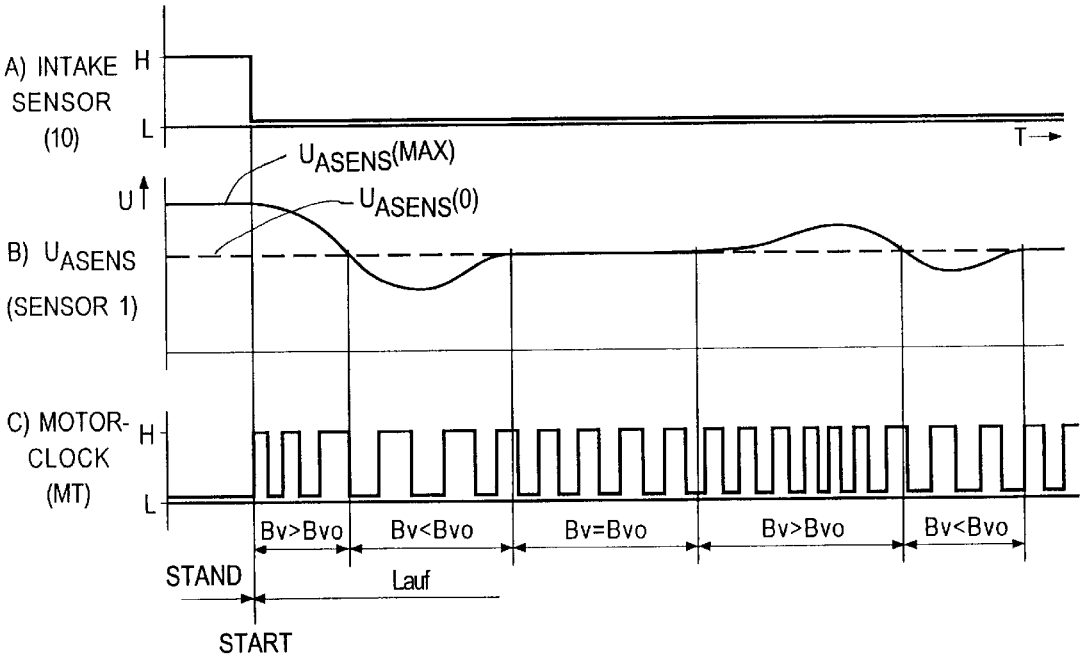

FIG. 3 Functional relationship between the logic signal of the intake sensor (10), the analog output signal ($U_{asens}$) of sensor (1) and the clock frequency to the motor drive in the start phase.

The lines a) to c) show the following:

a: logic signal of the intake sensor b: analog output signal ($U_{asens}$) of the sensor (1)

c: motor clock (MT) which results from the sensor signals of lines a) and b).

The task was formulated of controlling the document transport roller system (3) of a document acceptance unit, which is to accept largely printed documents from printers or copiers, with respect to the document acceptance rate in such a way that the document acceptance rate automatically and continuously adapts to the document output rate, wherein the document output rate can vary stochastically within broad limits. The output rate of the printer or copiers can therein vary within a range of approximately 25 mm/s to approximately 180 mm/s. The rate variation can therein occur from document to document or also within the acceptance of a document.

Within the scope of the solution of the task posed the focus was directed toward the constructional formation of the document intake channel, which forces the incoming document (12) through the curvature of the upper part (4) and the lower part (5) into a curvature transversely to the direction of transport and the curvature of the document (12) is reducible by the increase of the acceptance rate through the document transport roller system (3) of the document acceptance device.

FIG. 1 depicts schematically the cross section through the document intake channel with the disposition of the sensor (1) with the analog output signal ($U_{asens}$) the intake sensor (10) as well as the electrical arrangement of a voltage-controlled clock generator (5), as well as the motor drive (7) for the motor (8) which, via the transfer elements (9) is connected with the document transport roller system (3) of the document acceptance device.

FIG. 2 shows the functional relationship between the analog output signal ($U_{asens}$) of the sensor (1) and the frequency of the motor clock (MT).

The output signal ($U_{asens}$) is proportional to the activation path [length] of the activation element (10'). If the activation element (10') of sensor (1) is not actuated, the output signal ($U_{asens}$) for example has the highest level and the clock frequency of the motor clock is highest.

With increasing activation path of the activation element (10') the level of $U_{asens}$ is reduced whereby the clock frequency of the motor clock (MT) is also reduced. While the level of the output signal ($U_{asens}$) can vary between levels $U_0$ and $U_2$, a level $U_1$ is defined beginning with which no longer a motor clock (MT) is generated, and the motor stands still.

Consequently the entire frequency range from the maximum driving frequency to zero is realizable.

If the document (12) is inserted by the document output unit (11) with the document output rate (Bvo) into the document front fed channel (4, 5), the document (12) is first maximally curved in the curvature region of the document draw-in channel.

FIG. 3 depicts the functional tracing of the output signal ($U_{asens}$) of sensor (1) and thus the clock frequency of the motor clock (MT), as well as the logic output signal (Lsens) of the intake sensor (10) during the intake phase of the document. When the front edge of the document (12) reaches the intake sensor (10) the intake sensor (10) is activated and the logic output signal ($U_{asens}$) of the intake sensor (10) switches to logic "low".

With the high-low transition of the logic output signal ($U_{Lsens}$) the motor (8) is started. Since the document (12) has not yet been acquired by the document transport roller system (3), the document (12) is inserted with maximum curvature into the document draw-in channel and initially does not come into contact with the activation element (10')

of the sensor (1). Thus, the motor (8) starts at the conceptual maximum document draw-in rate.

If the document (12) is acquired by the document transport roller system (3), the document (12) in the curvature region, due to the increased document draw-in rate of the document transport roller system (3) is slightly tensed and the activation element (10') of the sensor (1) is activated. Through the actuation of the activation element (10') of the sensor (1) the analog output voltage ($U_{asens}$) is reduced and the voltage-controlled clock generator (6) reduces the clock frequency of the motor clock (MT) such that the document draw-in rate of the document transport roller system (3) is reduced. Through the frequency characteristic of the voltage-controlled clock generator (6) and the position of the activation element (10') of sensor (1) is adjusted the document draw-in rate at which the document (12) runs at a predetermined curvature through the document intake channel.

If the document output rate (Bvo) of the document output device (11) varies, the voltage-controlled clock generator (6) readjusts automatically the clock frequency for the motor clock (MT) such that for the document (12) the predetermined curvature obtains in the document intake channel.

FIG. 3 shows clearly that the motor is initially started at the maximum frequency of the motor clock (MT) and that the clock frequency is reduced with decreasing level of the output signal $U_{asens}$. During the intake of the document (12) into the document transport roller system (3), the frequency of the motor clock (MT), due to the regulation characteristic of the system the target frequency which is associated with the output rate and which is represented by the level $U_{asens}$ (U).

After a finite time the system has built up to the output rate and the document acceptance rate agrees sufficiently with the document output rate.

If variations occur in the document curvature which are caused by differing document output rates, the system responds automatically and adapts according to the regulation characteristic of the system the document acceptance rate with greatest rapidity to the document output rate.

Therewith the acceptance of documents from devices with differing document output rates is possible without electrical communication between the document output device (11) and the document acceptance device with respect to the document [output] rate and with respect to the document format without impermissible tensile force [being exerted] onto the documents.

LIST OF REFERENCE SYMBOLS

1 sensor with analog signal output
1' activation element of sensor (1)
2 document transport roller system of document output device (9)
3 document transport roller system of document acceptance device
4 upper part of document intake channel
5 lower part of document intake channel
6 voltage-controlled clock generator
7 electric motor drive
8 motor
9 transfer elements between motor (8) and document transport roller system (3) of the document acceptance device
10 intake sensor of document acceptance device
10' activation element for intake sensor (10)
11 document output device
12 document
By document draw-in rate
Bvo document output rate
H high level (high) of a logic signal
L low level (low) of a logic signal
M1 . . . M4 motor driving signals
MT motor clock
U voltage, general
$U_0$ highest level for the analog output signal $U_{asens}$
U1 level of analog output signal $U_{asens}$ beginning with which a motor clock is no longer generated
U2 lowest level of analog output signal $U_{asens}$
$U_{asens}$ analog output voltage of sensor 1
$U_{asens}$ (max) maximum analog output voltage of sensor 1
$U_{asens}$(0) analog output voltage of sensor 1 which is associated with the document output rate
$U_{Lsens}$ logic output signal of intake sensor (10)
Figures:

| | |
|---|---|
| 1 clock generator (voltage controlled) | motor drive |

2 b) motor clock
a) intake sensor (10) c) motor clock

What is claimed is:

1. Arrangement for the control of movement of document by the automatic adaptation of the document acceptance rate to the document output rate of output devices by means of an electrically driven motor, comprising a document intake channel which forces the incoming document into a curvature transversely to the direction of transport of the documents and the degree of curvature of the documents is a function of any tensile force on the documents, as well as in the region of curvature of the documents in the document intake channel a sensor in disposed which is activatable via the degree of the curvature of the documents, characterized in that the sensor (1) having an activation element (10') compromises an analog and continuous output signal, and the output signal of the sensor (1) is connected with a voltage-controlled oscillator (6) which effects a continuous change of the driving frequency for the electrically drive motor (8) as a function of the actuation of the activation element (10') of the sensor (1).

2. Arrangement as claimed in claim 1, characterized in that the sensor (1) effects a continuous output signal as a function of the position of the activation element (10') of the sensor (1).

3. Arrangement as claimed in claims 1 or 2, characterized in that the voltage-controlled oscillator (6) in the quiescent position of the activation element (10') of the sensor makes available the previously cited maximum frequency for driving the stepping motor for the document transport rollers.

4. Arrangement as claimed in one of claims 1 or 2 characterized in with the actuation of the activation element (10') of the sensor (1) the generated driving frequency for the electrically driven motor (8) is continuously reducible.

5. Arrangement as claimed in one of claims 1 or 2 characterized in that the driving frequency for the electrically driven motor (8) is reducible via the actuation of the activation element (10') of the sensor (1) down to zero frequency.

6. Arrangement as claimed in one of claims 1 or 2 characterized in that the frequency change of the voltage-controlled oscillator (6) is affected via a voltage-controlled current source.

7. An arrangement for controlling the movement of documents driven by a motor to an output device, comprising:

means for forcing incoming, documents into a curvature transversely to the direction of transport of the documents, the degree of curvature of the documents being a function of any tensile force on the documents as well as in the region of curvature of the documents;

means responsive to the degree of the curvature of the documents for generating an analog and continuous output signal; and means responsive to said output signal for effecting a continuous change of the driving frequency for the motor as a function of the degree of curvature of the document.

8. A method for controlling the movement of documents driven by a motor to an output device, comprising:

forcing incoming documents into a curvature transversely to the direction of transport of the documents, the degree of curvature of the documents being a function of any tensile force on the documents as well as in the region of curvature of the documents;

responsive to the degree of the curvature of the documents, generating an analog and continuous output signal; and responsive to said output signal, effecting a continuous change of the driving frequency for the motor as a function of the degree of curvature of the document.

* * * * *